US009177777B2

(12) United States Patent
Welkie

(10) Patent No.: US 9,177,777 B2
(45) Date of Patent: Nov. 3, 2015

(54) ORTHOGONAL ACCELERATION SYSTEM FOR TIME-OF-FLIGHT MASS SPECTROMETER

(71) Applicant: PerkinElmer Health Sciences, Inc., Waltham, MA (US)

(72) Inventor: David G. Welkie, Trumbull, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 14/610,003

(22) Filed: Jan. 30, 2015

(65) Prior Publication Data

US 2015/0155153 A1 Jun. 4, 2015

Related U.S. Application Data

(62) Division of application No. 13/828,512, filed on Mar. 14, 2013, now Pat. No. 8,975,580.

(51) Int. Cl.
*H01J 49/40* (2006.01)
*H01J 49/00* (2006.01)

(52) U.S. Cl.
CPC ..... *H01J 49/401* (2013.01); *H01J 49/0031* (2013.01); *H01J 49/403* (2013.01)

(58) Field of Classification Search
CPC .... H01J 49/0031; H01J 49/401; H01J 49/403
See application file for complete search history.

(56) References Cited

U.S. PATENT DOCUMENTS 2,938,116 A 5/1960 Benson et al.
6,469,296 B1 * 10/2002 Hansen et al. ..... 250/287
2002/0100870 A1 * 8/2002 Whitehouse et al. ..... 250/281
2002/0190199 A1 * 12/2002 Li ..... 250/287
2013/0009051 A1 * 1/2013 Park ..... 250/282
2014/0224982 A1 * 8/2014 Furuhashi ..... 250/287

OTHER PUBLICATIONS

Guilhaus et al., "Orthogonal Acceleration Time-of-Flight Mass Spectrometry," Mass Spectrometry Reviews, 19:65-107 (2000), NLT Dec. 2000.

Laiko et al., "Resolution and Spectral-line Shapes in the Reflecting Time-of-Flight Mass Spectrometer with Orthogonally Injected Ions," Rapid Communications in Mass Spectrometry, 8:720-726 (1994), NLT Dec. 1994.

Lewin et al., "Ion Dispersion near Grids in TOFMS the Critical Effect of the Angle of Incidence," Proceedings of the 49th ASMS Conference on Mass Spectrometry and Allied Topics, Chicago, Illinois, May 27-31, 2001 (2 pages), NLT May 2001.

Selby et al., "Reducing Grid Dispersion of Ions in Orthogonal Acceleration Time-of-Flight Mass Spectrometry: Advantage of Grids with Rectangular Repeat Cells," International Journal of Mass Spectrometry, 206:201-210 (2001), NLT Dec. 2001.

* cited by examiner

*Primary Examiner* — Nicole Ippolito
*Assistant Examiner* — Wyatt Stoffa
(74) *Attorney, Agent, or Firm* — Fish & Richardson P.C.

(57) ABSTRACT

An orthogonal pulse accelerator for a Time-of-Flight mass analyzer includes an electrically-conductive first plate extending in a first plane, and a second plate spaced from the first plate. The second plate includes a grid that defines a plurality of apertures each having a first dimension extending in a first direction and a second dimension orthogonal to the first dimension, the first and second dimensions lying in the second plane and the second dimension begin larger than the first dimension. The first and second plates are positioned in the Time-of-Flight mass analyzer to receive, during operation of the mass analyzer, an ion beam propagating in the first direction in a region between the first and second plates, and the orthogonal pulse accelerator directs ions in the ion beam through the apertures.

14 Claims, 9 Drawing Sheets

PRIOR ART

PRIOR ART

ORTHOGONAL ACCELERATION SYSTEM FOR TIME-OF-FLIGHT MASS SPECTROMETER

CROSS-REFERENCE TO RELATED APPLICATIONS

This application is a divisional of U.S. application Ser. No. 13/828,512, filed on Mar. 14, 2013, the entire contents of which are incorporated herein by reference.

TECHNICAL FIELD

This invention relates to orthogonal acceleration optics for pulsed acceleration of charged particles in a time-of-flight mass spectrometer.

BACKGROUND

In a time-of-flight (TOF) mass spectrometer with an orthogonal acceleration ('OA-TOF') configuration, a collimated primary ion beam is directed into a 'pulsing region' of the TOF orthogonal accelerator optics while the pulsing region is field-free (ideally). Typically, the pulsing region is configured as the region between two parallel, planar electrodes, with surfaces that are parallel to the primary beam axis and perpendicular to the time-of-flight direction in the TOF flight tube. The electrode farthest from the TOF flight tube is typically a solid flat plate, while the electrode between the primary beam and the TOF flight tube includes a grid with high transparency to ions. Additional gridded and/or non-gridded electrodes are additionally configured between the pulsing region gridded electrode and the TOF flight tube entrance, depending on the particular optical design employed. These electrodes form one or more constant acceleration fields in order to optimize mass resolution and transmission of ions. One or more pulsed voltages can be applied to one or more of these electrodes to generate a pulsed acceleration field in the pulsing region, directed perpendicular to the primary beam axis, which, together with any subsequent electric fields, results in the acceleration of a segment of the primary ion beam through the first pulsing region grid electrode and ultimately into the TOF flight tube.

A common orthogonal acceleration arrangement can include two stages of constant, but different, acceleration fields separated by a gridded electrode. The first acceleration stage includes the pulsing region, which is ideally field-free during the time period when the primary beam ions enter this region, but which then must abruptly provide the first acceleration stage by abruptly applying pulsed voltages to the pulsing region electrode(s). The second acceleration stage can end downstream with the TOF entrance grid electrode at a relatively large flight tube potential. The flight tube voltage is generally greater than would be practical to pulse, and so the flight tube voltage is typically applied to the TOF entrance grid continuously. Consequently, a strong electric field is present constantly in this second acceleration stage.

A gridded electrode that separates two regions of differing electric fields cannot completely isolate one electric field region from the other, at least not throughout the region bordered by the grid. In particular, a single grid cannot completely prevent the strong electric field of the second acceleration stage from generating a small electric field in the pulsing region, and thereby deflect the incoming primary ion beam and degrade TOF performance.

Various approaches can be used to mitigate this 'field penetration' effect in an orthogonal-acceleration arrangement.

For example, a constant voltage differential is often applied between the pulse region electrodes to counteract the field penetration. However, a grid electrode in the pulsing region usually includes a solid portion to physically support the grid, between which the primary beam must pass. The constant voltage differential creates electric fields along this solid portion, which interferes with the collimation of the primary beam and, therefore, TOF performance.

Consequently, a second gridded electrode is often incorporated between the first gridded electrode that borders the pulsing region, and the second acceleration stage. This second gridded electrode further reduces field penetration from the second acceleration stage into the pulsing region. Further, a constant voltage bias can be applied to this second gridded electrode to counteract field penetration into the pulsing region without generating electric fields in the pulsing region along the solid portion of the first gridded electrode. In this configuration, the first acceleration stage is developed during the pulse acceleration period between the solid plate electrode bordering the pulsing region, and the second gridded electrode. The voltages applied to the solid plate electrode, the first gridded electrode, and the second gridded electrode are selected such that the electric field of this first acceleration stage is constant during the pulse acceleration period. The solid plate electrode is often called the 'pusher' electrode, since ions are accelerated away from this electrode when the acceleration pulse occurs. Similarly, the gridded electrode that separates the first and second acceleration stages is often called the 'puller' electrode, since ions are initially accelerated towards this electrode. Finally, the gridded electrode between the pusher and puller electrodes, which borders the primary ion beam region, can be called the 'intermediate' pulsing region electrode.

Limitations to TOF performance arise from the deflections of ions by electric field distortions in the vicinity of the grid openings, or apertures, in a grid that separates regions of different electric field strengths. Such deflections, sometimes called 'grid scattering', are especially significant at the grid that separates the first and second stages of acceleration of a two-stage orthogonal acceleration TOF analyzer, due primarily to the oblique incident angle with which pulse-accelerated ions pass through this grid, combined with their relatively low kinetic energy at this point. Such an effect can be mitigated by placing grids having parallel wires oriented along the primary beam direction. However, such grids are challenging to form into a precisely flat plane due to a lack of supporting structures orthogonal to the grid wires. An acceptable compromise was found to be grids formed by two sets of orthogonally-oriented grid wires, but in which the spacing between grid wires oriented orthogonal to the plane of ion incidence was substantially greater than the wire spacing between wires oriented parallel to the plane of ion incidence (that is, parallel to the primary beam axis). Hence, such grids comprise rectangular shaped openings, or apertures, and are now frequently deployed in OA-TOF pulse acceleration optics where the long dimension of the openings are oriented parallel to the primary beam direction, resulting in improved transmission and resolving power, compared to grids with square apertures.

One approach to optimizing TOF performance is to minimize the components of the primary ions' velocity components in the TOF direction, that is, by ensuring that the primary beam is well-collimated. It is not possible to achieve perfect beam collimation, and imperfections in apparatus such as electrostatic lens aberration errors, mechanical misalignments, ion beam space charge broadening, local electric fields due to surface charges, all contribute to cause a small flux of ions to 'stray' from the ideal collimated beam path within the OA-TOF pulsing region. At least some of these 'stray' ions have trajectories that impinge on the intermediate pulsing region electrode. Such stray ions can cause increased baseline noise and/or artifact peaks in TOF mass spectra, impacting TOF performance.

SUMMARY

An orthogonal acceleration configuration for an OA-TOF mass analyzer includes two or more stages of acceleration, in which the first acceleration stage includes a pusher electrode, an intermediate electrode, and a puller electrode. The pusher electrode and the intermediate electrode form the upstream (relative to the TOF direction) portion of the first pulse acceleration stage through which the primary beam passes. Primary beam ions may have trajectories that stray from the ideal collimated beam profile, and impinge with grazing incident angles on the intermediate electrode grid, which may result in background noise, and/or artifact peaks, in TOF mass spectra when such stray ions pass through this grid.

A reduction of the spacing between grid wires of the intermediate pulsing region grid in the direction of the primary beam axis reduces (i.e. prevents) such detrimental effects. Given sufficient grid wire thickness normal to the plane of the grid, and sufficiently small spacing between the wires of the grid oriented orthogonal to the primary beam axis, it was found that such detrimental effects could be greatly reduced or completely eliminated as a result of the stray ions impacting the grid wires at grazing incidence. Essentially, the line-of-sight for grazing incident stray ions from the upstream side of the intermediate grid to the downstream side of the intermediate grid is eliminated. Further, the loss of transmission of ions through the intermediate grid, as the spacing between grid wires in the primary beam axis direction is reduced, is avoided by concomitantly increasing the spacing between grid wires of the intermediate grid in the orthogonal direction, thereby maintaining the open-area ratio, hence transmission efficiency, of the grid. (A slightly greater increase in the orthogonal direction spacing compensates for the slight extra loss of ion transmission for ions pulse-accelerated through the intermediate grid, due to their angle of incidence being not quite orthogonal to the intermediate grid, owing to their primary beam velocity components). The result is a grid configuration composed of rectangular openings, having the short dimension of the openings oriented perpendicular to the primary beam axis.

In one aspect, an orthogonal pulse accelerator for a Time-of-Flight mass analyzer includes an electrically-conductive first plate extending in a first plane, a second plate spaced from the first plate, the second plate extending in a second plane parallel to the first plane. The second plate includes a grid that defines apertures each having a first dimension extending in a first direction and a second dimension orthogonal to the first dimension, the first and second dimensions lying in the second plane and the second dimension being larger than the first dimension. The first and second plates are positioned in the Time-of-Flight mass analyzer to receive, during operation of the mass analyzer, an ion beam propagating in the first direction in a region between the first and second plates, and the orthogonal pulse accelerator directs ions in the ion beam through the apertures.

Implementations include one or more of the following features. At least some of the apertures are rectangular apertures. For the rectangular apertures, the first dimension corresponds to a width of each rectangle and the second dimension corresponds to a length of the rectangle. Each of the apertures has the same shape. The first dimension is between 0.05 mm-0.5 mm. The first dimension is 0.13 mm. The second dimension is between 0.3 mm to 2.0 mm. The second dimension is 0.85 mm. A grid density along the first direction is greater than in a direction orthogonal to the first direction. The grid includes electrically-conductive wires. The wires have square, or rectangular, or circular, or arbitrary-shaped cross-sections and characteristic dimensions in any direction of between 5-100 micron. The wires are of square cross-section, having a side dimension of 30 microns. The grid has a circular shape in the second plane. The second plate is electrically-conductive. The grid has a thickness which in combination with the grid density in the first direction is sufficient to obstruct at least some of the ions incident on the grid at a grazing incidence angle with respect to the second plane.

A third electrically conductive-plate extending in a third plane downstream of the second plate and parallel to the second plane. The third plate includes a second grid. The second grid defining a second plurality of apertures each having a third dimension extending in the first direction and a fourth dimension orthogonal to the third dimension, the third and fourth dimensions lying in the third plane, the third dimension being larger than the fourth dimension. The orthogonal pulse accelerator further includes a detector.

The orthogonal pulse accelerator further includes a reflectron. The Time-of-Flight mass analyzer further includes a flight tube.

In one aspect, a method includes directing an ion beam in a first direction within in a region between a first electrically-conductive plate extending in a first plane and a second plate extending in a second plane parallel to the first plane, the second plate comprising a grid that defines a plurality of apertures each having a first dimension extending in the first direction and a second dimension orthogonal to the first dimension, the first and second dimensions lying in the second plane and the second dimension being larger than the first dimension. Applying a voltage on the first electrically-conductive plate to accelerate ions in the ion beam in the region through the apertures of the second plate.

Implementations can include one or more of the following features. The method includes obstructing at least some of the ions incident on the aperture at a grazing incidence angle with respect to the second plane before the voltage is applied. The region is separated from the first electrically-conductive plate and the second plate by an equal distance along a direction orthogonal to the first direction. The second plate is arranged to cause a reduction in transmission of ions in the ion beam incident on the aperture at a grazing incidence angle with respect to the second plane. The method includes directing the ions in the ion beam to a detector to obtain a spectrum indicative of m/z ratios of the ions. The method includes eliminating artifact signals from the spectrum. Directing the ions which have passed through the apertures of the second plate through an electrically-conductive third plate; the third plate extending in a third plane parallel to the second plane. The third plate includes a second grid that defines a second plurality of apertures each having a third dimension extending in the first direction and a fourth dimension orthogonal to the third dimension, the third and fourth dimensions lying in the third plane, the third dimension being larger than the fourth dimension. The ions in the ion beam pass through the second plurality of apertures. The method includes applying a voltage on the first electrically-conductive plate includes applying a voltage of between −10 V to −2000 V for negative ions, or from +10 to +2000 V for positive ions, to the first plate. The voltage is −0.4 V. The method includes directing the ions in the ion beam that have passed through the second plurality of apertures into a flight tube. The flight tube is maintained at a voltage between 3 kV to 25 kV. The method includes applying a voltage of between −30 V to +3000 V to the third plate. The voltage is −15V. The flight tube is maintained at a voltage of 5 kV. The flight tube is maintained at a voltage of 8 kV. The flight tube is maintained at a voltage of 10 kV. The method includes reducing artifact signals from registering at a detector, and internally grounding the second plate.

DESCRIPTION OF DRAWINGS

Like reference symbols in the various drawings indicate like elements.

DETAILED DESCRIPTION

Figure 1:
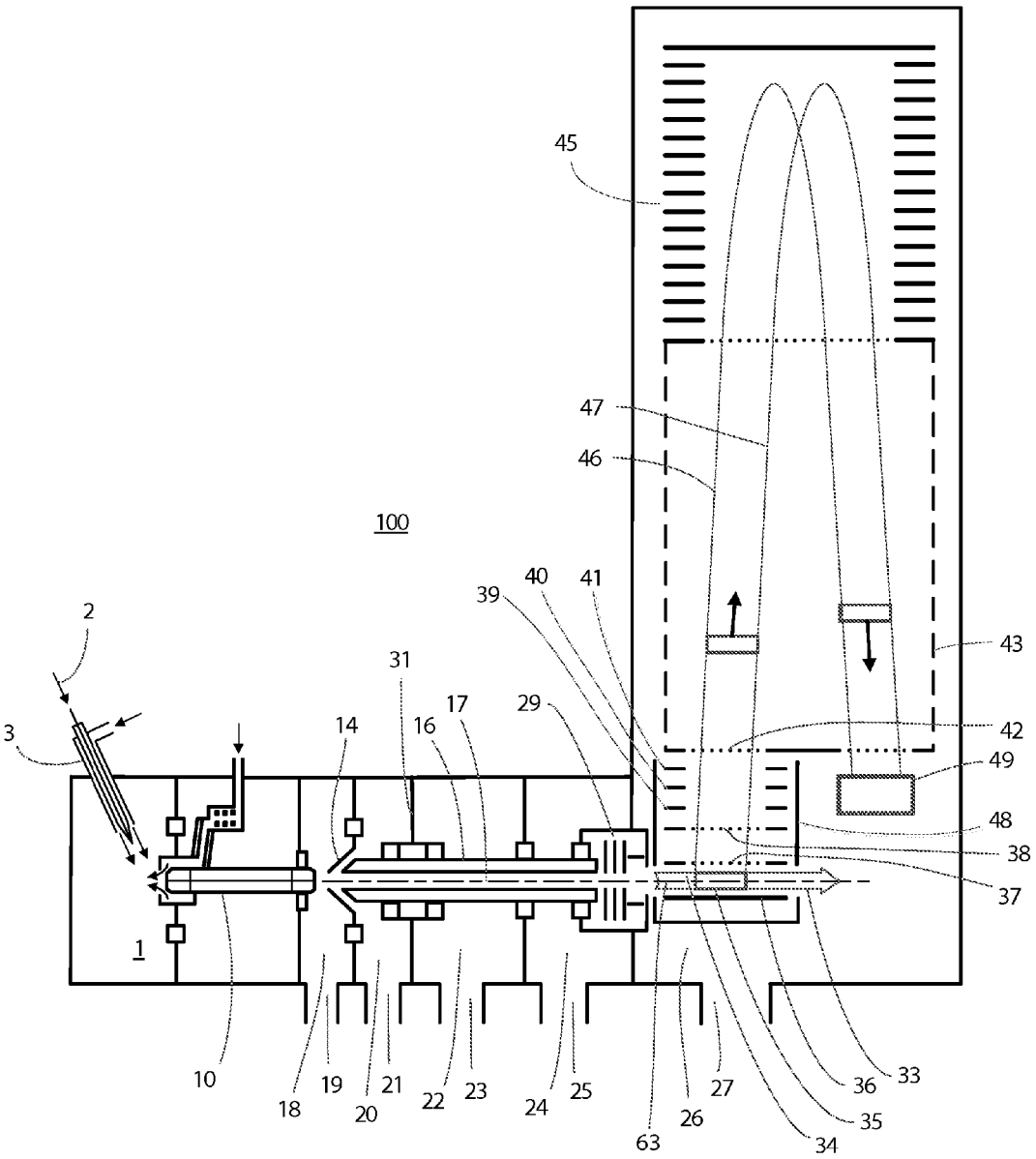
FIG. 1 is a schematic diagram showing an embodiment of a mass spectrometry system having an orthogonal acceleration (OA) time-of-flight mass analyzer system.

FIG. 1 shows an electrospray ionization/time-of-flight (TOF) mass spectrometer system 100. This system includes five stages (18, 20, 22, 24, and 26) of vacuum pumping. Vacuum stage 18 is evacuated by a roughing pump (not shown) via vacuum pumping port 19. Vacuum pumping stages 20, 22, 24 and 26 are evacuated via four stages, respectively, of a four-stage turbo pump (not shown) via vacuum pumping ports 21, 23, 25 and 27, respectively.

Ions are created in electrospray ion source 1 from liquid sample solution 2 flowing into sample probe 3. Sample ions move from the ion source 1 through dielectric capillary 10 into the vacuum stage 18. The ions continue to pass through skimmer 14, RF multipole ion guide 16, and are focused into a collimated ion beam 33 by electrostatic lens assembly 29. The collimated ion beam 33 passes into orthogonal acceleration (OA) pulsing region 34 between pusher electrode 36 and grid intermediate electrode 37 during the 'ion filling' period, that is, while the OA pulsing region 34 is field free. The primary ion beam enters a region in the pulsing region 34 along an axis 17 that is parallel to the pusher electrode 36 and the grid intermediate electrode 37 surfaces during this 'ion filing' period.

A segment of the ion beam 33 is pulse-accelerated as an ion packet 35 from the pulsing region 34 toward TOF flight tube 43 when pulse voltages are abruptly applied to and maintained on the solid pusher electrode 36 and grid puller electrode 38 during the 'pulse-active' period. The ion packet 35 is accelerated through pulse acceleration optics assembly 48 and through flight tube entrance grid 42 into the flight tube 43. The leading and trailing ends of ion packet 35 follow trajectories 47 and 46, respectively, as the ion packet 35 travels from the OA pulsing region 34 through the pulse acceleration optics assembly 48, the flight tube 43, reflectron 45, to TOF detector 49. Ions within the ion packet 35 travel nominally along trajectories between and parallel to trajectories 46 and 47.

The OA configuration of FIG. 1 includes two stages of acceleration. The first stage of acceleration, that is, during the 'pulse-active' period, includes applying a constant electric field between pusher electrode 36 and grid puller electrode 38. In order that this electric field is constant throughout the distance between these two electrodes, that is, the dependence of the potential is linear with distance between the pusher electrode 36 and the grid puller electrode 38, requires that the voltage applied to grid intermediate electrode 37 corresponds to the potential of this linear potential gradient at the position of the grid intermediate electrode 37. The second stage of acceleration is a second linear potential gradient between the grid puller electrode 38 and the flight tube entrance grid 42. Ring electrodes 39, 40, and 41 have voltages applied corresponding to the voltages of this second linear potential gradient at their respective positions. The voltages applied to ring electrodes 39, 40, and 41, and to the flight tube entrance grid 42, are typically kept constant, that is, are applied during the pulse-active period as well as during the ion filling period, so an electric field is always present in this second acceleration stage.

During the ion filling period, it is preferable that the pulsing region 34 be free of electric fields that would deflect or distort the ion beam 33 as it passes into and through this region. To this end, the voltage applied to pusher electrode 36 is kept essentially the same as that applied to grid intermediate electrode 37 (except for a possible small voltage difference (e.g., PL1 bias, applied to the pusher electrode 36) to provide a steering correction of any misalignment between the primary ion beam axis 17 and the axis 63 of the pulsing region 34). For example, the voltage of the grid intermediate electrode 37 may be fixed at ground potential, so a nominal field-free region between the pusher electrode 36 and the grid intermediate electrode 37 is established when the potential on the pusher electrode 36 is nominally 0V. Also, in order to prevent the constant electric field in the second acceleration stage from penetrating through the grid puller electrode 38 and the grid intermediate electrode 37 into the pulsing region 34, a voltage (e.g., PL3 bias) is applied to the grid puller electrode 38 that compensates for this penetration, thereby ensuring that pulsing region 34 is field-free during the ion filling period. For example, PL3 bias may be a voltage of opposite polarity from the drift voltage, and adjusted to 'buck', or compensate for, field penetration from the acceleration field present in the second acceleration stage during the 'ion filling' period.

In some embodiments, the distance between the pusher electrode 36 and the grid intermediate electrode 37 is the same as the distance between the grid intermediate electrode 37 and the grid puller electrode 38.

In such embodiments, during the pulsing period, with the grid intermediate electrode 37 maintained at ground potential, and the pulse voltage applied to the grid puller electrode 38 (−Vp) equal and opposite polarity to the pusher electrode 36 voltage (+Vp), an essentially constant pulse-acceleration electric field is established between the pusher electrode 36 and the grid puller electrode 38. This field forms the first pulse-acceleration stage electric field during the pulsing period. The distance between the grid puller electrode 38 to the grid intermediate electrode 37 does not have to be the same as that from the pusher electrode 36 to the grid intermediate electrode 37, provided that the pulse voltages applied to pusher electrode 36 and grid puller electrode 38 are adjusted so that the electric field between the pusher electrode 36 and the grid intermediate electrode 37 is essentially the same as the electric field between the grid intermediate electrode 37 and the grid puller electrode 38 when these voltages are applied during the acceleration pulse.

The second constant acceleration stage electric field is formed between grid puller electrode 38 (−Vp) and flight tube entrance grid 42 (the drift tube voltage Vd) with the help of field termination rings electrodes 39, 40, and 41, which have voltages applied intermediate between the grid puller electrode 38 pulse voltage and the drift tube voltage so as to create the constant second stage electric field when the grid puller electrode 38 voltage equals −Vp during the acceleration pulse.

An exemplary selection of voltages is tabulated in Table 1 below for positive ions:

| | Electrode | | | | | | |
|---|---|---|---|---|---|---|---|
| Mode (+Ions) | 36 | 37 | 38 | 39 | 40 | 41 | 42 |
| Ion Filling | PL1 Bias | 0 v. | PL3 Bias | −Vp + ¼(−Vd + Vp) | −Vp + ½(−Vd + Vp) | −Vp + ¾(−Vd + Vp) | −Vd |
| Pulsed | +Vp | 0 v. | −Vp | −Vp + ¼(−Vd + Vp) | −Vp + ½(−Vd + Vp) | −Vp + ¾(−Vd + Vp) | −Vd |

Exemplary values of the variable parameter can be: PL1 bias=0 V, Vp=700 V, PL 3 bias=+20 V, Vd=−10,000 V.

For negative ions, the same absolute values of voltages as for positive ions, but opposite polarity, are exemplary.

Figure 2:
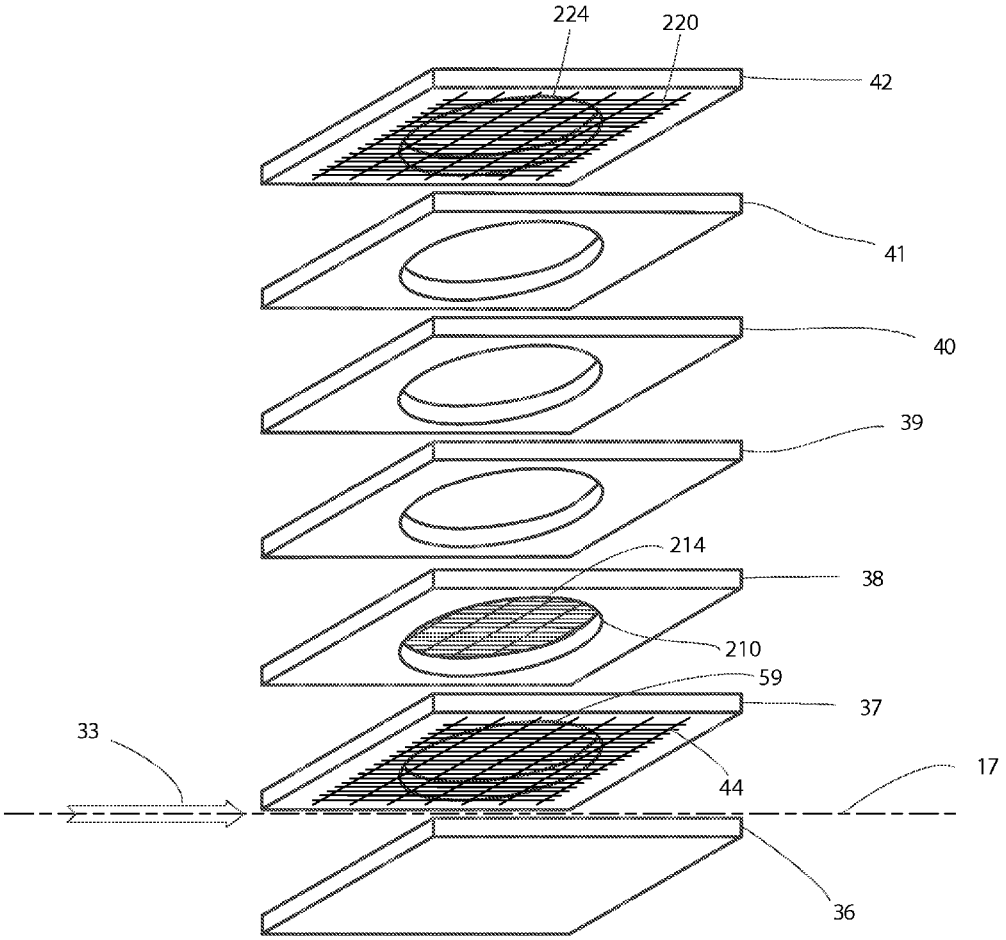
FIG. 2 shows an exploded perspective view of an orthogonal acceleration electrode arrangement.
Figure 3:
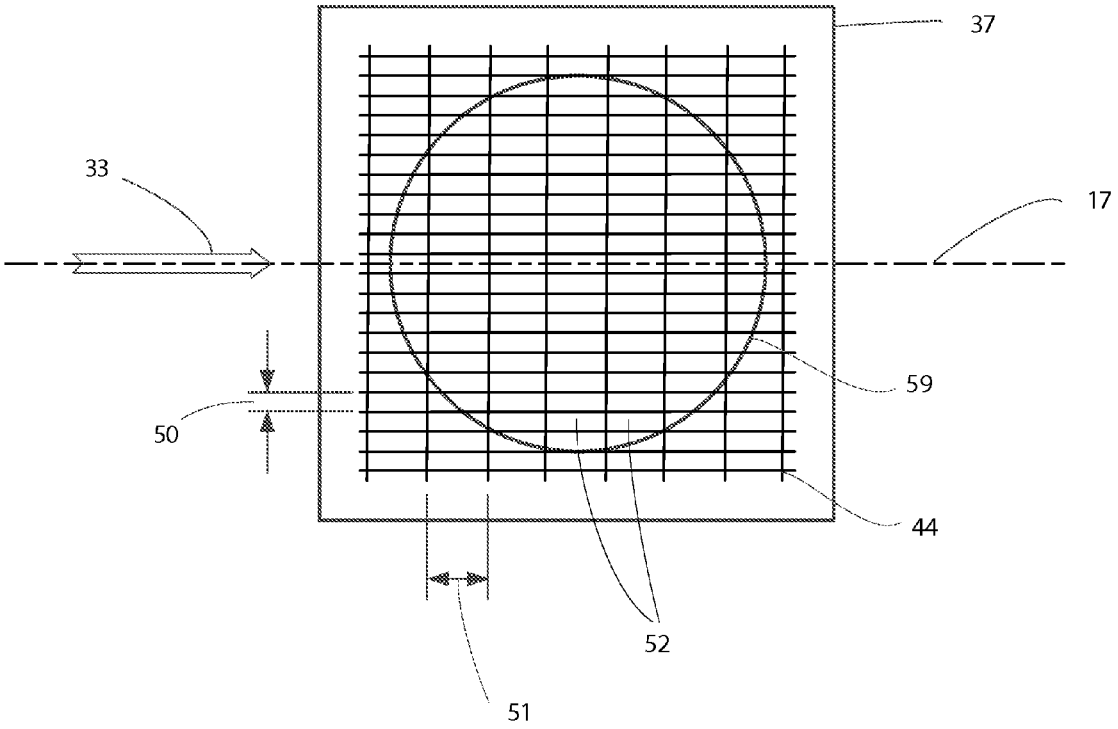
FIG. 3 is a frontal view of the intermediate electrode shown in FIG. 2.

As shown in FIG. 2, the puller electrode 38 has a central circular aperture 59 and a grid 44 in contact with a perimeter of the aperture 59. While the central aperture 59 is circular in this embodiment, any shape aperture will also be acceptable, provided that the aperture size and shape matches that of the corresponding aperture 210 in the puller grid electrode 38. The grid 44 contains apertures 52, as shown in FIG. 3. Optimum TOF time-focusing of ions in ion packet 35 at the TOF detector 49 generally requires that the electric field in the first stage of the pulse acceleration optics assembly 48 between the pusher electrode 36 and the grid puller electrode 38 be different from the electric field in the second stage between grid puller electrode 38 and the flight tube entrance grid 42. Ions experience deflections as they traverse the apertures 52 of the grid puller electrode 38 due to so-called grid scattering by local electric field distortions at the grid apertures 52. The same is true, albeit to a lesser degree, at the grid apertures of the flight tube entrance grid 42, which separates the electric field of the second acceleration stage from the field-free flight tube region. Such deflections degrade TOF sensitivity and resolving power.

TOF performance degradation can be reduced in crossed-wire grid structures, such as grid puller electrode 38 and flight tube entrance grid 42, by increasing the spacing between the grid wires that are oriented orthogonal to the ion beam axis 17. It was thought that no similar benefit would be realized by configuring the grid intermediate electrode 37 the same way, because the electric field strength is the same on either side of this grid 37, so no significant grid scattering effects would result in any case.

However, for the sake of consistency of construction and minimizing the number of different parts of the instrument (that is, for lowering the associated cost of production), the grid intermediate electrode 37 would typically be configured the same way as the grid puller electrode 38 and the flight tube entrance grid 42. This is illustrated in FIGS. 2 and 3. FIG. 2 is an exploded perspective view of the pulse acceleration optics assembly 48 of FIG. 1. Grid intermediate electrode 37, grid puller electrode 38, and flight tube entrance grid electrode 42 are all fabricated with rectangular apertures 52, with the long dimension of the apertures 52 oriented parallel to the ion beam axis 17. The grid 44 is arranged on the surface of the grid intermediate electrode 37 that is closer to the pusher electrode 36. This is shown more clearly in FIG. 3, which depicts the grid intermediate electrode grid 37 in frontal view. In FIG. 3, the long dimension 51 of the grid rectangular apertures 52, which are aligned parallel to the primary beam axis 17, is larger than the short dimension 50 of the apertures. In the embodiment shown in FIG. 3, the ratio between the long dimension 51 and the short dimension 50 is about 3.5. In general, this ratio can be greater, for example, 5, 10 or even 20 or more. The puller electrode 38 also has a central circular aperture 210. In contact with a perimeter of the aperture 210 is a grid 214, a long dimension of the grid 214 is arranged parallel to the long dimension 51 of the grid 44. The grid 214 is arranged on a face of the grid puller electrode 38 that is closer to the ring electrode 39. The flight tube entrance grid 42 has a central circular aperture 224, and a grid 220 in contact with a perimeter of the aperture 224. The grid 220 is arranged on a surface of the flight tube entrance grid 42 that is closer to the ring electrode 41. Exemplary dimensions of this arrangement include: the distance between the pusher and intermediate electrodes is about 5 mm, and between the intermediate electrode and the puller electrode is about 5 mm, and the diameters of the apertures 59 and 210 are about 45 mm.

A commercial instrument incorporating the essential design features of FIGS. 1-3 was used to acquire TOF mass spectra. A liquid sample mixture of calibration compounds was infused continuously into the sample probe 3 of electrospray ion source 1 at an infusion rate of 10 microliters/min. An ion beam segment was pulse-accelerated as ion packet 35 periodically, using pulse acceleration optics assembly 48, which included pusher electrode 36, grid intermediate electrode 37, grid puller electrode 38, intermediate ring electrodes 39, 40, and 41, and flight tube entrance grid 42 oriented as shown in FIGS. 2 and 3 with respect to the primary ion beam axis 17. The long dimension 51 of the grid apertures of each of the grid electrodes 37, 38 and 42 is aligned parallel to the primary beam axis 17. These grids may be fabricated with wires of square, rectangular, circular, or arbitrary-shaped cross-section, with characteristic dimensions in any direction of between 5-100 micron. For example, the wires of the grids used were approximately 0.03 mm on a side, and spaced apart about 0.85 mm in the long dimension, and about 0.13 mm in the short dimension, resulting in a ratio between these dimensions of about 6.5. The apertures 52 in grid 44 may have the same shape. The long dimension may be as large as possible for increased transmission, constrained only by considerations of structural robustness of the grid, and can typically be between 0.3 mm-2.0 mm, or more. The short dimension is typically between 0.05 mm to 0.5 mm. A grid density along the short dimension is greater than a grid density along the long dimension. The grid density is related to the number of grid wires per unit length in a given direction. The grid is sufficiently thick so that the more closely-spaced grid wires oriented perpendicular to the primary beam axis obstruct at least some of the ions incident on the aperture 44 at a grazing incidence angle with respect to the grid intermediate electrode 37.

Each ion beam segment, pulse accelerated from the primary ion beam 33 traversing the pulsing region 34, is separated during its passage through the TOF analyzer into constituent ions having different mass-to-charge values. The resulting output signal from the TOF detector 49 is digitized and recorded in digital memory as a function of time using an analog-to-digital converter (ADC) coupled to a memory array. Alternatively, a time-to-digital converter (TDC) may be used instead of an ADC to register the arrival times of ions. The time dependence of this output signal is interpreted as a mass-to-charge spectrum. Several thousands of such TOF spectra are typically integrated from an equal number of pulse accelerated primary ion beam segments to produce an average spectrum.

Figure 4A:
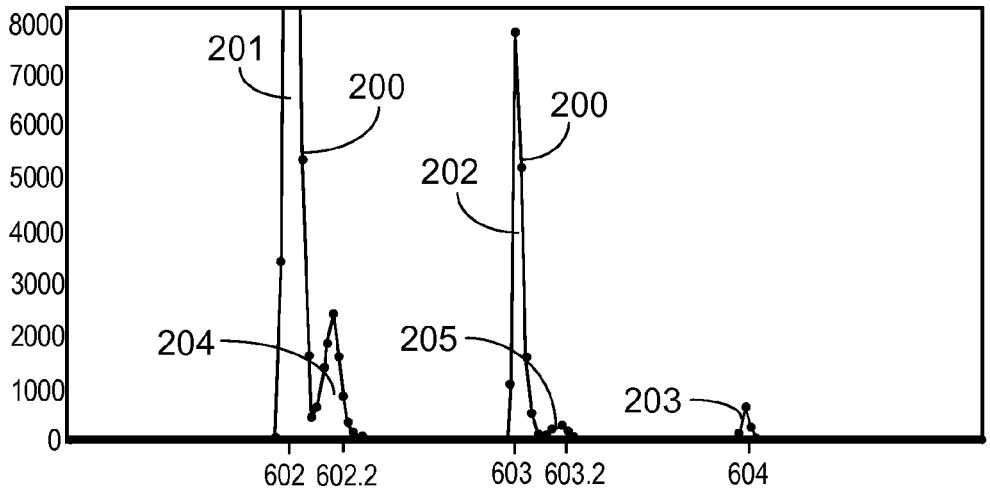
FIGS. 4*a*-4*c* are spectra obtained from the arrangement shown in FIG. 2.
Figure 4B:
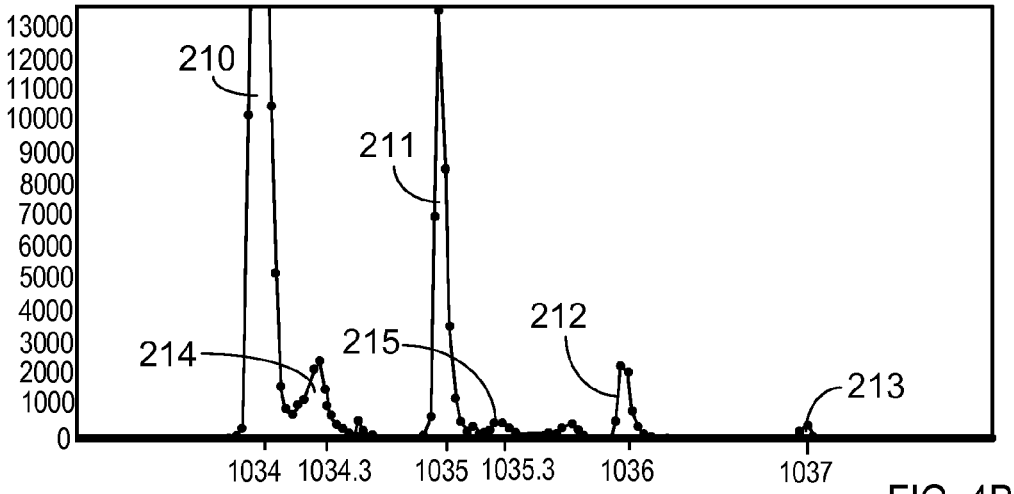
Figure 4C:
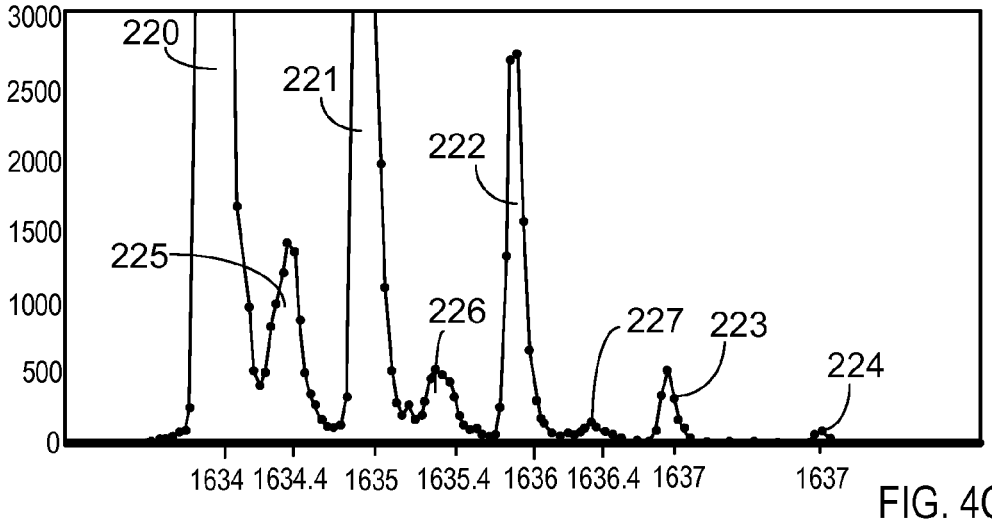

FIGS. 4*a*, 4*b*, and 4*c* show three portions, respectively, of such a TOF m/z spectrum acquired with the system of FIG. 1, where each portion is an expansion in both horizontal (m/z) and vertical (intensity) scales of the spectrum regions around three calibrant ion mass peaks, respectively. The exemplary data points 200 displayed in the spectra represent the ion flux intensity at the TOF detector 49, at consecutive 1 nanosecond increments along the time (m/z) axis. The m/z resolving power demonstrated in these spectra is about 10,000.

The spectrum portion shown in FIG. 4*a* is the mass-to-charge spectrum of one calibrant compound, in which the first (largest) peak 201 is the monoisotopic mass peak of the compound at a m/z value of about 602. The peaks 202 and 203 at m/z values at about 603 and 604, respectively, shown in FIG. 4*a* are the m/z peaks corresponding to the isotopes of the same compound. The other peaks 204 and 205 at m/z of about 602.2 and 603.2, respectively, that are apparent in the spectrum were concluded, based on experimental results, to result from 'stray' ions from the primary ion beam, having m/z values the same as those of m/z peaks 201 and 202, respectively. Without wishing to be bound to any theory, the 'stray' ions of these m/z values may have passed close to or through the grid intermediate electrode 37, resulting in their deflection by residual electric fields in the vicinity of the grid intermediate electrode 37, during the ion-filling period, before the pulse acceleration occurred. Due to the deflections, these 'stray' ions exhibit a distribution of initial trajectories that is characteristically different from the initial trajectory distribution of other ions of the same m/z values in the primary ion beam during the ion-filling period. These differences in the initial trajectories result in variations in the time-focusing at the TOF detector 49 between stray and non-stray ions of the same m/z value. Time-focusing refers to the essentially simultaneous arrival of all ions of a given m/z value at the detector, regardless of their initial positions and initial velocities, due to the action of the electric fields in the TOF analyzer. These extra peaks 204 and 205 are artifacts in that they appear to arise from ions of the same m/z as the main peak, but for some reason are time-focused at the detector slightly delayed after the ions of the main peak arrive at the detector. Consequently, the stray ions generate peaks 204 and 205 that are located at incorrect positions on the m/z scale (shown in FIG. 4*a*) compared to the m/z positions determined from the flight times of the non-stray calibrant ions. The amplitudes of the artifact peaks (e.g., 204, 205) can be as much as a few percent of that of the main peaks (e.g., 201, 202). Therefore, these 'artifact' peaks are prone to be misattributed to ions of a different m/z value than those ions that constitute the main peaks. In other words, these 'artifact' peaks are "false positives"—they are misinterpreted as being attributed to sample constituents that do not actually exist in the sample.

FIGS. 4*b* and 4*c* are portions of the same m/z spectrum as FIG. 4*a*, but for different calibrant compounds in the sample calibration mixture. The second calibrant compound of FIG. 4*b* produces a monoisotopic peak 210 at about m/z 1034, with corresponding isotope peaks 211, 212, and 213 at m/z values of about 1035, 1036, and 1037, respectively. The peaks 214 and 215 are, again, 'artifact' peaks at apparent m/z values of about 1034.3 and 1035.3, respectively, when their actual m/z values should have been 1034 and 1305, respectively (i.e., same as the ions generating the peaks 210 and 211, respectively) Similarly, the third calibrant compound of FIG. 4*c* produces a monoisotopic peak 220 at about m/z 1634, with corresponding isotope peaks 221, 222, 223, and 224 at m/z values of about 1635, 1636, 1637, and 1638, respectively. The peaks 225, 226, and 227 are, again, 'artifact' peaks at apparent m/z values of about 1634.4, 1635.4, and 1636.4, respectively. Their actual m/z values are about 1634, 1635 and 1636, respectively (i.e. the same as the ions generating the peaks 220, 221, and 222, respectively).

Without wishing to be bound by theory, the relative positions of the artifact peaks and their response to changes in the bias voltage applied to the pusher electrode 36 and the bias voltage applied to the grid puller electrode 38 suggest that the artifact peaks are due to ions in the primary ion beam 33 that have penetrated the region between the grid intermediate electrode 37 and the grid puller electrode 38. In contrast, most of the primary ions remain within the pulsing region 34 between the pusher electrode 36 and the grid intermediate electrode 37. Those ions that have penetrated past the grid intermediate electrode 37 before the TOF pulse occurs then experience the field between the grid intermediate electrode 37 and grid puller electrode 38. This field was originally designed to counteract penetration of the field from the downstream acceleration stage (i.e. the second stage of acceleration) into the pulsing region 34 between the pusher electrode 36 and the grid intermediate electrode 37, and is consequently repulsive to ions moving in the direction from grid intermediate electrode 37 to grid puller electrode 38. Therefore, ions penetrating past the grid intermediate electrode 37 will be stopped (i.e., in the TOF direction, or from grid intermediate electrode 37 to grid puller electrode 38) and will instead turn around to proceed back into the pulsing region 34 between the pusher electrode and the grid intermediate electrode. Without being limited to any particular theory, it is believed the artifact peaks are due to these ions that have turned around and continue to move in the opposite direction from the pulse acceleration direction (i.e., away from pusher electrode 36 towards grid intermediate electrode 37) when the TOF acceleration pulse occurs. These ions will then be focused in a similar fashion as the other primary beam ions, but will exhibit a 'turn-around' effect, and will be focused in time at the detector slightly later than the primary beam ions that have not deviated from the primary axis 17 prior to the TOF acceleration pulse, thereby creating an 'artifact' peak.

These "stray" ions may be generated from the primary ion beam by, for example, normal focusing aberrations characteristics of electrostatic lenses (e.g., electrostatic lens assembly 29), ion beam space charge effects, or mechanical misalignments, etc.

A Simion® model was created that included three-dimensional grid wires with dimensions as close as possible to the actual device. Simion is charged particle simulation software commercially available from Scientific Instrument Services (Ringoes, N.J.). Computational constraints relating to array size limit a full 3D model of the pulse optics to a model mesh resolution of no finer than 100 μm. While the actual grid has gird wires having cross-sectional dimensions of about 30 μm, and an aspect ratio and spacing of 30×200 lines/inch (lpi), the model was constructed with grid dimensions of 9.4×50.8 lpi, and grid wires having a cross-sectional dimension of 100 μm.

Figure 5A:
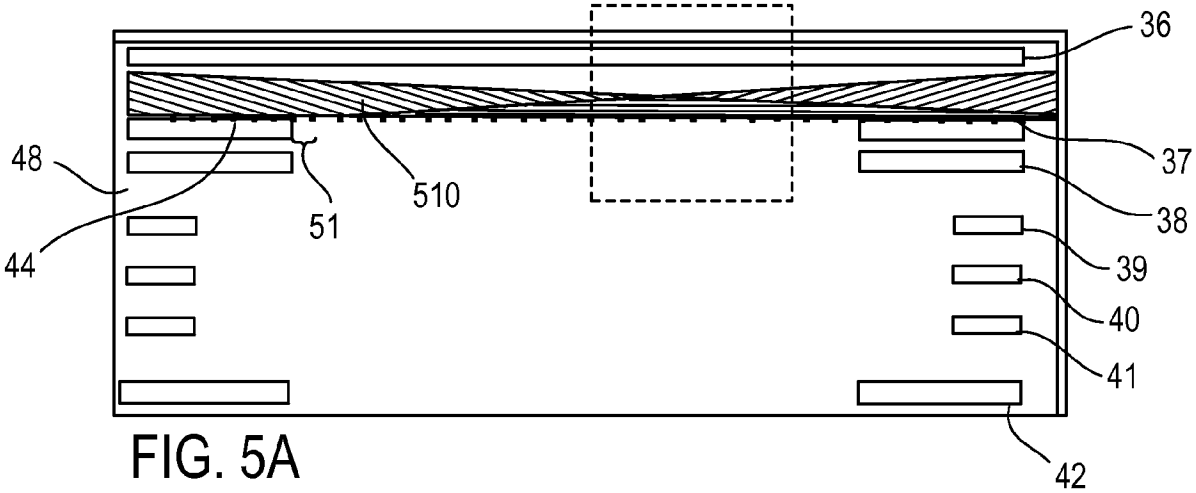
FIGS. 5*a*-5*b* are calculations obtained using Simion based on the arrangement shown in FIG. 2.
Figure 5B:
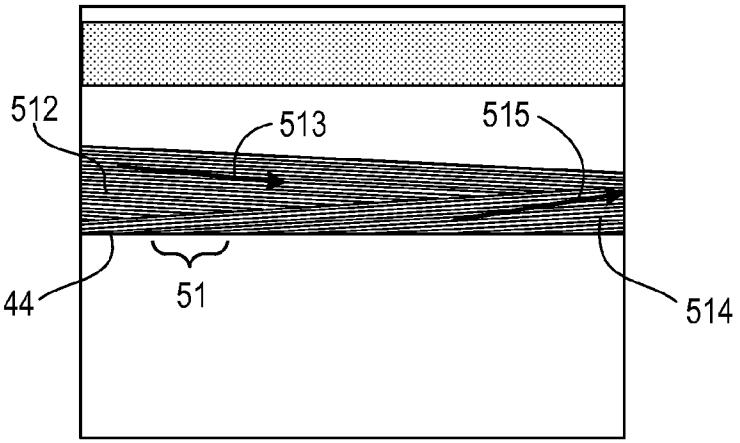

FIGS. 5A and 5B show the results from electric field and trajectory calculations performed with this exemplary model geometry using Simion®. Only exemplary stray ions 510 are depicted to illustrate the source of the artifact peak; the main ions in the primary beam are not shown for the sake of clarity. The ion trajectories depicted in FIGS. 5A and 5B correspond to the 'ion-filling' period. During this period, voltages were applied to the electrodes of this model similar to the values provided in connection with Table 1 above. FIG. 5B provides a close up of the region marked with dashed lines in FIG. 5A. 'Stray' ions 510 impinge on grid 44 along direction 513. It is apparent that ions passing close to the grid 44, for example, along portion 51, are repelled back into the pulsing region, such that repelled ions 514 acquire new trajectories along direction515. When the acceleration pulse is applied, these stray ions experience the acceleration pulse towards the TOF drift tube, the same as the other primary beam ions, but the 'stray' ions start out with an initial velocity in the opposite direction (along the component of direction 515 in the TOF direction, vs. the component of direction 512 in the TOF direction), and must reverse their velocity in the TOF direction before accelerating toward the TOF drift tube. These stray ions will then be time-focused at the TOF detector, but will have a small time delay relative to the main ion population due to the 'turn-around' delay they experienced in the pulsing region, which gives rise to the observed artifact peak.

Upon discovering that the 'artifact' peaks 204, 205, 214, 215, 225, 226 and 227 in the spectra of FIGS. 4*a*-4*c* likely resulted from 'stray' ions approaching and/or penetrating the grid intermediate electrode 37 of FIG. 1, it was realized that these 'stray' ions would be approaching and/or penetrating the grid intermediate electrode 37 at substantially grazing angles of incidence until the TOF acceleration pulse is applied. Grazing angles of incidence can include angles between 0.5 to 10° measured from the plane of the grid intermediate electrode 37. As such, it would be expected that these 'stray' ions could be prevented from contributing to the measured TOF m/z spectra if the grid intermediate electrode 37 includes wires that were oriented perpendicular to the primary ion beam axis 17, and that these wires were spaced closely enough together to essentially intercept the 'stray' ions and remove them from the primary ion beam ion population before the TOF pulse acceleration was applied. In other words, a finer grid mesh density of the grid intermediate electrode 37 along the primary beam axis 17 (i.e., a reduction of the spacing between grid wires) would help to mitigate (i.e., eliminate) the presence of such 'artifact' peaks. The finer grid mesh density would help to create an effect similar to a 'venetian blind', where ions at a grazing angle of incidence would be more likely to hit an orthogonal grid wire than penetrate through the grid openings. Given sufficient grid wire thickness normal to the plane of the grid, and sufficiently small spacing between the wires of the grid oriented orthogonal to the primary beam axis, detrimental effects that led to 'artifact' peaks could be greatly reduced (e.g., completely eliminated) as a result of the stray ions impacting the grid wires at grazing incidence. Essentially, the line-of-sight for grazing incident stray ions from the upstream side of the intermediate grid to the downstream side of the intermediate grid is reduced (e.g., eliminated). Further, the loss of transmission of ions through the intermediate grid, as the spacing between grid wires in the primary beam axis direction is reduced, is avoided by concomitantly increasing the spacing between grid wires of the intermediate grid in the orthogonal direction, thereby maintaining the open-area ratio, hence transmission efficiency, of the grid. The open-area ratio of the electrode is the fraction of the total electrode grid area that is open for the passage of ions, or light, etc. In other words, a slightly greater increase in the orthogonal direction spacing compensates for the slight extra loss of ion transmission for ions pulse-accelerated through the intermediate grid. The slight extra loss in transmission of ion is due to a portion of the primary ion beam having primary beam velocity components that result in angles of incidence that are not sufficiently orthogonal to the intermediate grid during the pulse acceleration period, which can also be compensated by a slight further increase in the orthogonal direction spacing.

The grids used on the grid intermediate electrode 37, grid puller electrode 38 and flight tube entrance grid 42 have different wire spacing in two orthogonal directions, creating rectangular apertures in the grid. Such rectangular apertures have been demonstrated to result in less ion scattering when a grid separates regions of different field strengths, resulting in higher transmission and resolving power, than with square mesh grids. Nonetheless, only the puller electrode 38 and the flight tube entrance grid 42 separate regions of differing field strength. Grid intermediate electrode 37 does not, in fact, separate regions of differing field strengths. Nonetheless, some embodiments use grid electrodes having rectangular apertures for all three grid electrodes. One way to achieve a finer grid density in the primary beam direction without any other consequences is to rotate the grid intermediate electrode 37 by 90°. This approach avoids the introduction of a new grid with different dimensions, and is therefore preferable from a manufacturing cost perspective. However, this should not be construed as limiting the invention, as the grid spacings of this intermediate grid can just as effectively be different from that of the puller and flight tube entrance grids.

Figure 6:
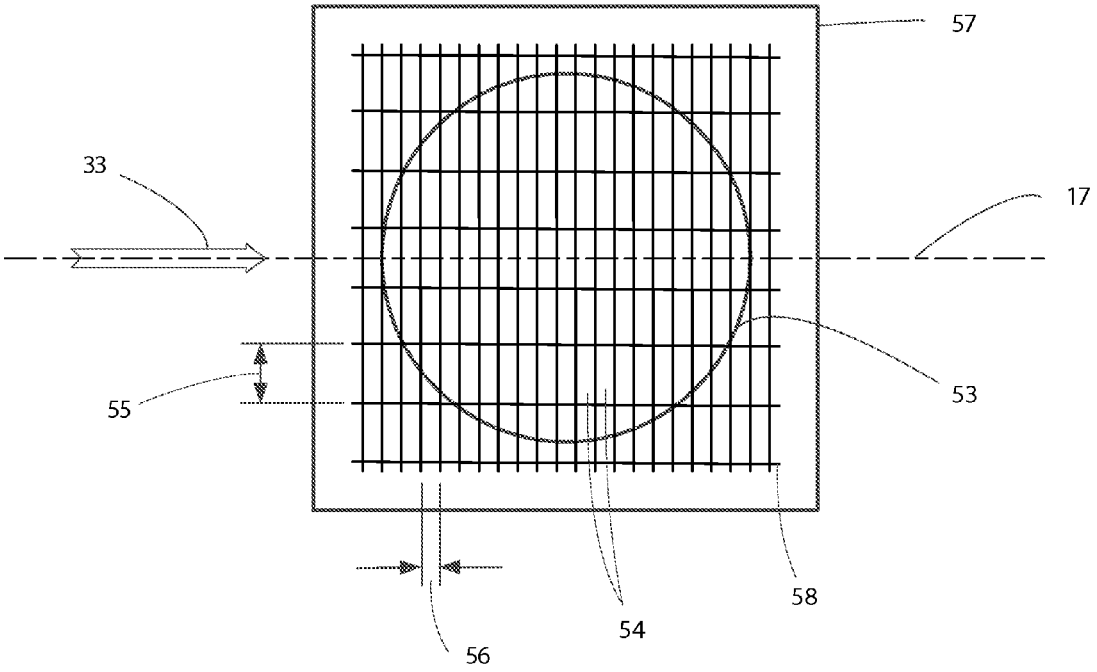
FIG. 6 is a frontal view of an intermediate electrode.
Figure 7:
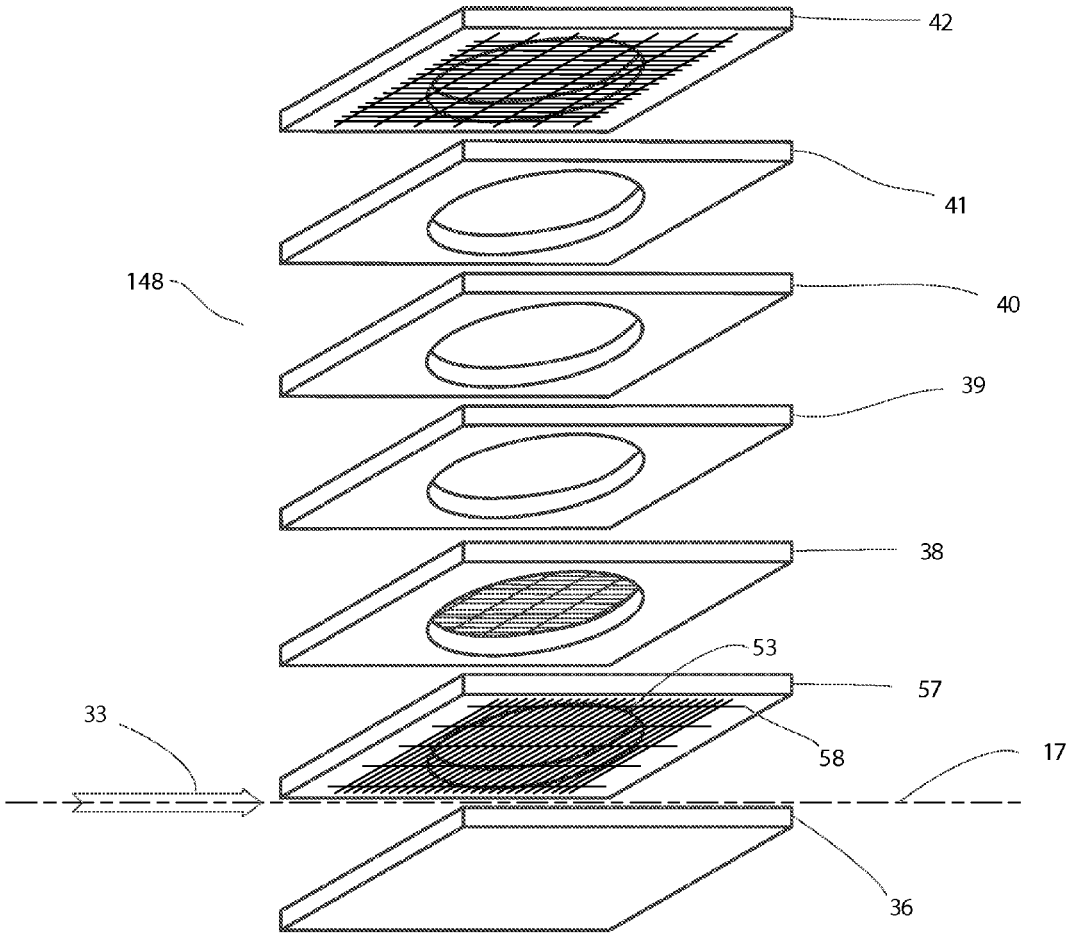
FIG. 7 shows an exploded perspective view of an orthogonal acceleration electrode arrangement having grids with rectangular apertures oriented according to FIG. 6.

An experiment was performed that validated this approach. A grid configuration was provided by simply rotating the conventional grid intermediate electrode 37 by 90 degrees, as illustrated in FIG. 6. In other words, the orientation of grid intermediate electrode 37 shown in FIG. 3 was changed to the orientation of the grid intermediate electrode 57 shown in FIG. 6. Accordingly, the short spacing 56 between grid wires was oriented parallel to the primary ion beam 33 and the long dimension 55 between grid wires is oriented perpendicular to the beam axis 17. FIG. 7 further illustrates the new orientation of the intermediate electrode grid 57 in the TOF pulse acceleration assembly 148.

Figure 8A:
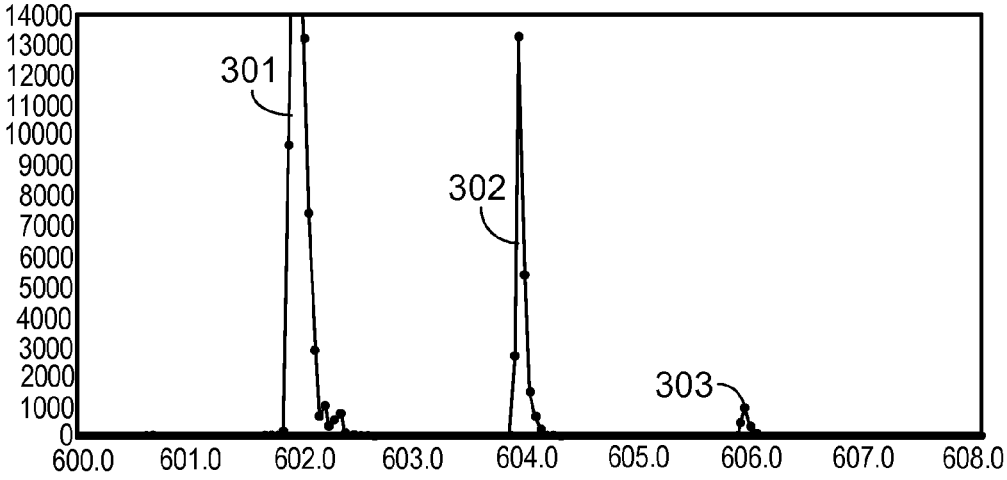
FIGS. 8*a*-8*c* are spectra obtained from the arrangement shown in FIG. 7.
Figure 8B:
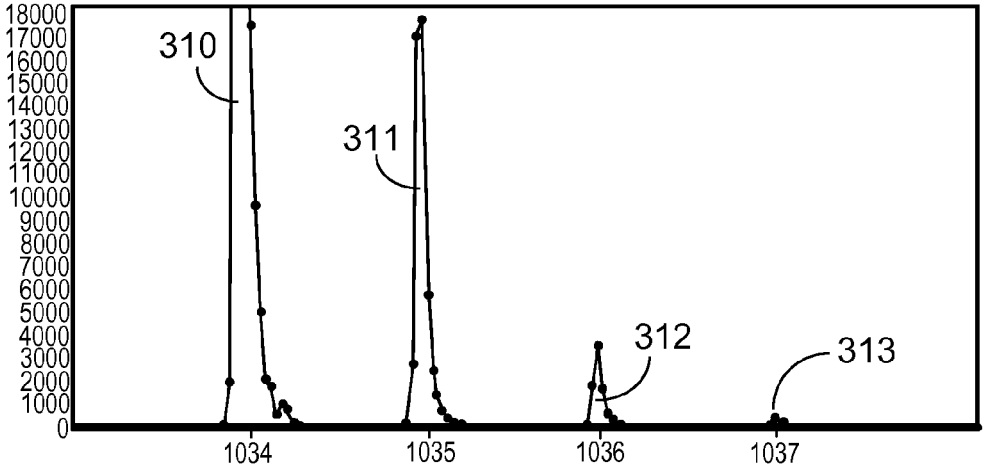
Figure 8C:
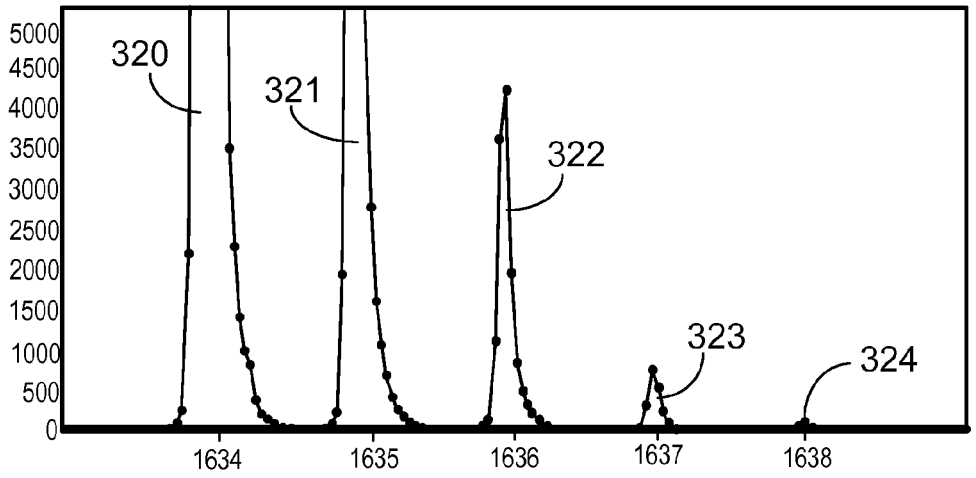

After this change in the orientation of intermediate electrode grid 57 was made, TOF spectra were acquired under essentially the same conditions and instrument settings as those used to acquire the TOF m/z spectra of FIGS. 4*a*-4*c*. FIGS. 7*a*-7*c* show expanded portions of various acquired spectra similar to those displayed in FIGS. 4*a*-4*c*. The differences in the spectra between FIGS. 8*a*-8*c* and FIGS. 4*a*-4*c* are due to the grid intermediate electrode 57 having been rotated 90° as shown in FIGS. 6 and 7 compared to grid intermediate electrode 37. FIG. 8*a* shows isotope peaks 301, 302, and 303 of the calibrant compound having a monoisotopic mass 602, essentially the same as the m/z value of peak 201 in FIG. 4*a*. FIG. 8*b* shows isotope peaks 310, 311, 312, and 313 of the calibrant compound having a monoisotopic mass 1034, the same as the m/z value of peak 210 in FIG. 4*b*. FIG. 8*c* shows isotope peaks 320, 321, 322, 323, and 324 of the calibrant compound having monoisotopic mass 1634, the same as m/z value of peak 220 in FIG. 4*c*. It is apparent that the 'artifact' peaks 204 and 205 of FIG. 4*a*; 214 and 215 of FIG. 4*b*; and 225, 226, and 227 of FIG. 4*c* have been greatly reduced, (i.e., eliminated). The small peaks that remain, for example, at the high-m/z base side of peaks 301 and 310, are known to be characteristic of the TOF detector itself, unrelated to the 'stray' ion artifact peaks. The measurements shown above were taken at a flight tube voltage of +10 kV in negative ion mode. However, a similar benefit would be expected with respect to eliminating or reducing such artifact peaks if they appear in positive ion spectra as well. Measurement data also indicates that a system having the rotated intermediate grid electrode works well also at a flight tube voltage of 5 kV and 8 kV.

This modification of the orientation of the grid intermediate electrode, that is, configuring the grid intermediate electrode grid so that closely-spaced wires of the intermediate electrode grid are oriented orthogonal to the primary ion beam axis 17, was repeated on a second instrument of the same design, and the improved results were essentially identical.

The efficacy of this approach depends on the actual grazing angles of incidence that the 'stray' primary beam ions make with the grid intermediate electrode; the spacing between the grid intermediate electrode wires that are oriented perpendicular to the primary ion beam axis; as well as the thickness of the intermediate electrode wires; all of which determine the line-of-sight of the 'stray' ions through the apertures of the intermediate electrode grid. The line-of-sight of an ion is its trajectory when not subjected to further external fields.

The orientation of grid intermediate electrode 57 and the pulse voltage arrangements ensure that the electric field is the same on either side of the intermediate grid during the period of pulse acceleration. Hence, essentially no grid scattering occurs at this intermediate grid, regardless of the grid wire spacing.

Figure 9A:
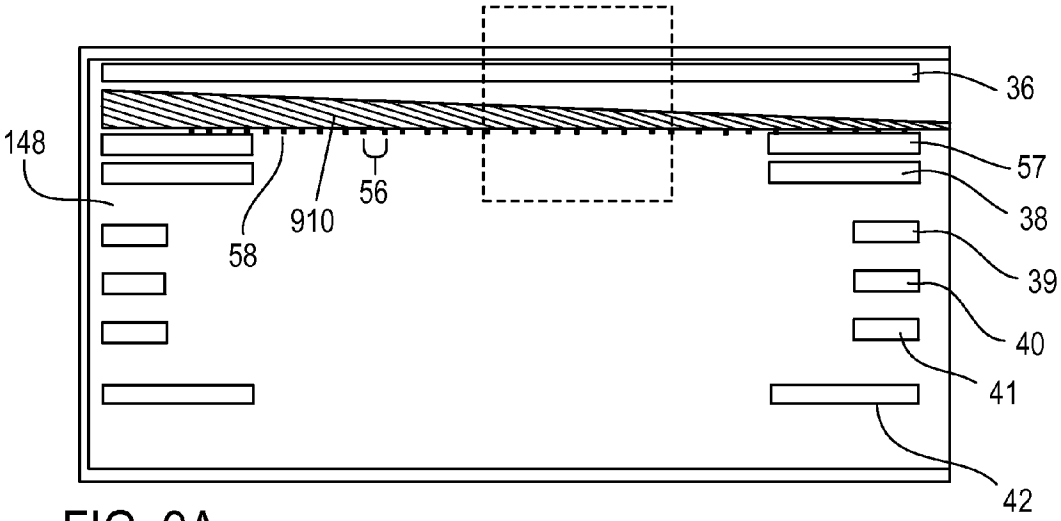
FIGS. 9*a* and 9*b* are calculations of particle trajectories based on the arrangement shown in FIG. 7.
Figure 9B:
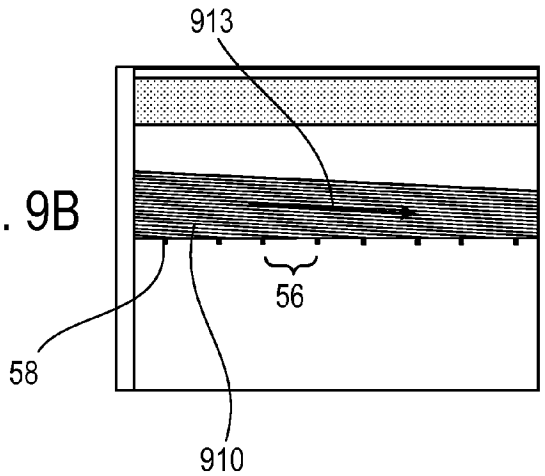

The Simion® calculation shown in FIG. 9A demonstrates that the steered ions 910 are now completely blocked by the more closely-spaced grid wires 58, in contrast to the penetration shown in FIG. 5B for the pre-rotated grid orientation. This is illustrated more clearly in the expanded view of FIG. 9B below. FIG. 9B is a close up view of the region marked with dashed lines in FIG. 9A. Stray ions 910 approach the grid 53 along a direction 913. The grid 58 has its short spacing 56 in a plane orthogonal to the plane of the drawing. These ions are intercepted by the more densely arranged grid wires along the short spacing 56 of the grid 58 and do not subsequently generate 'artifact' peaks at the detector.

Other embodiments are in the following claims.

What is claimed is:

1. A method, comprising:

directing an ion beam in a first direction within a region between a first electrically-conductive plate extending in a first plane and a second plate extending in a second plane parallel to the first plane, the second plate comprising a grid that defines a plurality of apertures each having a first dimension extending in the first direction and a second dimension orthogonal to the first dimension, the first and second dimensions lying in the second plane and the second dimension being larger than the first dimension;

receiving an ion beam propagating in the first direction in the region between the first and second plates while a first electric field between the first and second plates is essentially zero; and applying a first voltage on the first electrically-conductive plate to produce a second electric field between the first and second plates to accelerate at least a portion of ions in the ion beam in the region through the apertures of the second plate such that an electric field strength in the region between the first and second plates is essentially identical to an electric field strength in a region on an opposite side of the second plate, away from the first plate.

2. The method of claim 1, further comprising obstructing at least some of the ions incident on the aperture at a grazing incidence angle with respect to the second plane before the voltage is applied.

3. The method of claim 1, wherein the region is separated from the first electrically-conductive plate and the second plate by an equal distance along a direction orthogonal to the first direction.

4. The method of claim 1, wherein the second plate is arranged to cause a reduction in transmission of ions in the ion beam incident on the aperture at a grazing incidence angle with respect to the second plane.

5. The method of claim 1, further comprising directing the ions in the ion beam to a detector to obtain a spectrum indicative of m/z ratios of the ions.

6. The method of claim 5, further comprising eliminating artifact signals from the spectrum.

7. The method of claim 1, further comprising directing the ions which have passed through the apertures of the second plate through an electrically-conductive third plate; the third plate extending in a third plane parallel to the second plane, the third plate comprising a second grid that defines a second plurality of apertures each having a third dimension extending in the first direction and a fourth dimension orthogonal to the third dimension, the third and fourth dimensions lying in the third plane, the third dimension being larger than the fourth dimension, wherein the ions in the ion beam pass through the second plurality of apertures.

8. The method of claim 1, wherein applying the first voltage on the first electrically-conductive plate comprises applying a voltage of between −10 V to −2000 V for negative ions, or from +10 to +2000 V for positive ions, to the first plate.

9. The method of claim 7, further comprising directing the ions in the ion beam that have passed through the second plurality of apertures into a flight tube.

10. The method of claim 9, wherein the flight tube is maintained at a voltage between 3 kV to 25 kV for negative ions and from −3 kV to −25 kV for positive ions.

11. The method of claim 1, further comprising reducing artifact signals from registering at a detector.

12. The method of claim 1, further comprising internally grounding the second plate.

13. The method of claim 7, further comprising applying a second voltage to the third plate such that the electric field strength between the second and third plate is essentially identical to the electric field strength between the first and second plate.

14. The method of claim 13, wherein applying the second voltage on the third plate comprises applying a voltage between 10 V to 2000 V for negative ions, or from −10 to −2000 V for positive ions, to the third plate.

* * * * *